United States Patent [19]

Haizmann et al.

[11] Patent Number: 5,043,525

[45] Date of Patent: Aug. 27, 1991

[54] PARAFFIN ISOMERIZATION AND LIQUID PHASE ADSORPTIVE PRODUCT SEPARATION

[75] Inventors: Robert S. Haizmann, Rolling Meadows, Ill.; Frederick M. Hibbs, London, England; Srikantiah Raghuram, Darien, Ill.

[73] Assignee: UOP, Des Plaines, Ill.

[21] Appl. No.: 560,655

[22] Filed: Jul. 30, 1990

[51] Int. Cl.[5] ..... C07C 5/13; C07C 7/12

[52] U.S. Cl. ..... 585/737; 585/738; 585/748; 585/821; 585/826

[58] Field of Search ..... 585/737, 738, 748, 821, 585/826

[56] References Cited

U.S. PATENT DOCUMENTS

| | | | |
|---|---|---|---|
| 2,966,528 | 12/1960 | Haensel | 260/666 |
| 3,755,144 | 8/1973 | Asselin | 208/95 |
| 4,210,771 | 7/1980 | Holcombe | 585/738 |
| 4,717,784 | 1/1988 | Stem et al. | 585/738 |
| 4,804,802 | 2/1989 | Evans et al. | 585/734 |
| 4,956,521 | 9/1990 | Volles | 585/737 |

*Primary Examiner*—Anthony McFarlane
*Assistant Examiner*—Nhat Phan
*Attorney, Agent, or Firm*—Thomas K. McBride; John G. Tolomei

[57] ABSTRACT

A combination isomerization and liquid phase adsorptive separation process is given increased efficiency and cost effectiveness while also improving the product quality by eliminating the columns for the separation of desorbent material from extract and raffinate streams. In this arrangement a $C_5+$ naphtha stream is split into a heavy hydrocarbon stream comprising normal hexane and higher boiling hydrocarbons and an isomerization zone feedstream comprising isohexane and lower boiling hydrocarbons. The heavy hydrocarbon stream goes directly to a deisohexanizer column. The isomerization zone feedstream is combined with an excess desorbent stream and the extract stream from an adsorptive separation section to form a combined feed. Hydrocarbons in the combined feed are isomerized and after stabilization pass directly into the adsorption section. In the adsorption section, normal pentanes are selectively adsorbed on an adsorbent material, and a raffinate stream comprising desorbent and isoparaffins is passed to the deisohexanizer column and supplies the desorbent for the adsorption section. Any desorbent in excess of that required for the adsorption section is combined with the isomerization zone feed. The extract stream that is combined with the isomerization zone feed is recovered from adsorption section. A bottoms stream comprising $C_7$ and higher boiling hydrocarbons is withdrawn from the bottom of the deisohexanizer column. A high octane isomerate is taken overhead from the deisohexanizer as a product stream.

13 Claims, 1 Drawing Sheet

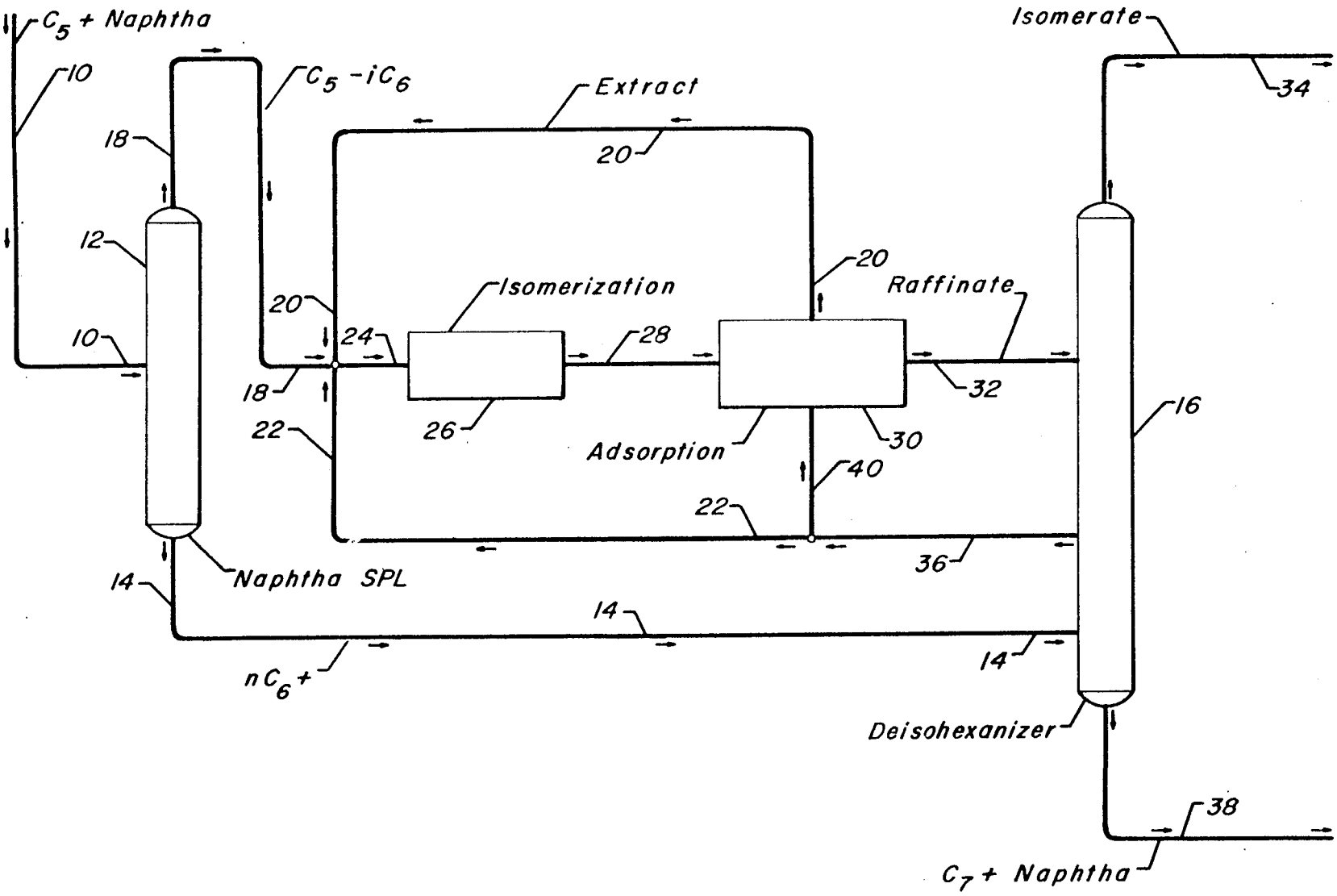
Isomerate
34
16
38
$C_7$ + Naphtha
Deisohexanizer
14
36
Raffinate
32
30
40
20
Adsorption
22
Extract
20
Isomerization
28
26
14
$C_5$ -$iC_6$
24
20
18
22
Naphtha SPL
$nC_6$+
$C_5$ + Naphtha
18
12
10
14
10

PARAFFIN ISOMERIZATION AND LIQUID PHASE ADSORPTIVE PRODUCT SEPARATION

BACKGROUND OF THE INVENTION

This invention relates generally to the isomerization of hydrocarbons. This invention relates more specifically to the isomerization of light paraffins using a solid catalyst, and the separation of more highly branched paraffins from less highly branched paraffins by adsorptive separation.

DESCRIPTION OF THE PRIOR ART

High octane gasoline is required for modern gasoline engines. Formerly it was common to accomplish octane number improvement by the use of various lead-containing additives. As lead is phased out of gasoline for environmental reasons, it has become increasingly necessary to rearrange the structure of the hydrocarbons used in gasoline blending in order to obtain high octane levels. Catalytic reforming and catalytic isomerization are two widely used processes for this upgrading.

A gasoline blending pool normally includes $C_4$ and heavier hydrocarbons having boiling points of less than 205° C. (395° F.) at atmospheric pressure. This range of hydrocarbon includes $C_4$–$C_6$ paraffins and especially the $C_5$ and $C_6$ normal paraffins which have relatively low octane numbers. The $C_4$–$C_6$ hydrocarbons have the greatest susceptibility to octane improvement by lead addition and were formerly upgrade in this manner. Octane improvement can also be obtained by using isomerization to rearrange the structure of the paraffinic hydrocarbons into branched-chain paraffins or reforming to convert the $C_6$ and heavier hydrocarbons to aromatic compounds. Normal $C_5$ hydrocarbons are not readily converted into aromatics, therefore, the common practice has been to isomerize these lighter hydrocarbons into corresponding branched-chain isoparaffins. Although the $C_6$ and heavier hydrocarbons can be upgraded into aromatics through hydrocyclization, the conversion of $C_6$'s to aromatics creates higher density species and increases gas yields with both effects leading to a reduction in liquid volume yields. Therefore, it is common practice to charge the $C_6$ paraffins to an isomerization unit to obtain $C_6$ isoparaffin hydrocarbons. Consequently, octane upgrading commonly uses isomerization to convert $C_6$ and lighter boiling hydrocarbons and reforming to convert $C_7$ and higher boiling hydrocarbons.

The effluent from an isomerization zone will contain a mixture of more highly branched and less highly branched paraffins. In order to further increase the octane of the products from the isomerization zone, normal paraffins, and sometimes less highly branched isoparaffins, are typically recycled to the isomerization zone along with the feed stream in order to increase the ratio of less highly branched paraffins to more highly branched paraffins entering the isomerization zone. A variety of methods are known to treat the effluent from the isomerization zone for the recovery of normal paraffins and monomethyl branched isoparaffins for recycling these less highly branched paraffins to the isomerization zone.

U.S. Pat. No. 2,966,528 issued to Haensel discloses a process for the isomerization of $C_6$ hydrocarbons and the adsorptive separation of normal hydrocarbons from branched chain hydrocarbons. The process adsorbs normal hydrocarbons from the effluent of the isomerization zone and recovers the unadsorbed hydrocarbons as product, desorbs straight chain hydrocarbons using a normal paraffin desorbent, and returns the desorbent and adsorbed straight chain hydrocarbons to the isomerization zone.

U.S. Pat. No. 3,755,144 shows a process for the isomerization of a pentane/hexane feed and the separation of normal paraffins from the isomerization zone effluent. The isomerization zone effluent is separated by a molecular sieve separation zone that includes facilities for the recovery of desorbent from the normal paraffin containing stream that is recycled to the isomerization zone. An extract stream that contains isoparaffins is sent to a deisohexanizer column that separates isopentane and dimethyl butane as a product stream and provides a recycle stream of isohexane that is returned to the isomerization zone.

U.S. Pat. Nos. 4,717,784 and 4,804,802 disclose processes for the isomerization of a hydrocarbon feed and the use of adsorptive separation to generate normal paraffin and monomethyl-branched paraffin recycle streams. The effluent from the isomerization zone enters a molecular sieve separation zone that contains a 5A-type sieve and a ferrierite-type sieve that adsorb normal paraffins and monomethyl-branched paraffins, respectively. U.S. Pat. No. 4,804,802 discloses steam or hydrogen as the desorbent for desorbing the normal paraffins and monomethyl-branched paraffins from the adsorption section and teaches that steam or hydrogen may be recycled with the normal paraffins or monomethyl-branched paraffins to the isomerization zone.

One method of separating normal paraffins from isoparaffins uses adsorptive separation under liquid phase conditions. In such methods, the isomerization effluent contacts a solid adsorbent having a selectivity for normal paraffins to effect the selective adsorption of normal paraffins and allow recovery of the isoparaffins as a high octane product. Contacting the normal paraffin containing adsorbent with the desorbent material in a desorption step removes normal paraffins from the adsorbent for recycle to the isomerization zone. Both the isoparaffin and normal paraffin containing streams undergo a separation for the recovery of desorbent before the isoparaffins are recovered as a product and the normal paraffins recycled to the isomerization zone. Liquid phase adsorption has been carried out in conventional swing bed systems as shown in U.S. Pat. No. 2,966,528. The use of simulated moving bed systems for the selective adsorption of normal paraffins is also known and disclosed by U.S. Pat. No. 3,755,144. Simulated moving bed systems have the advantage of increasing recovery and purity of the adsorbed and non-adsorbed components in the isomerization zone effluent for a given unit of adsorbent material.

In liquid phase adsorption systems the adsorbent contains selective pores that will more strongly adsorb the selectively adsorbed components in the feed mixture. The selective pore volume is limited and the quantity of such pores must accommodate the desired volume of components to be adsorbed from the feed mixture. The desorbent material is also a selectively adsorbed component. Therefore, an extract column is typically used to recover desorbent, otherwise any desorbent that passes through the reactors of the reactors of the isomerization zone and enters the adsorption section increases the amount of adsorbed component in the feed mixture and requires additional adsorbent. If the quantity of selectively adsorbed components is increased without increasing the available selective pore volume for a given unit of feed, it was believed that the purity of the extract and raffinate streams from the adsorption section decreases. Therefore, the extract column has been viewed as necessary for the desorption stage of the adsorption section since the loaded adsorbent contains normal paraffins and desorbent material as adsorbed components and all of these adsorbed components must be displaced by the desorbent. Without the extract column, desorbent flow during the desorption step would increase if traditional desorbent to pore volume ratios are maintained thereby placing a greater quantity of desorbent in circulation and increasing the amount of selective pore volume needed during the feed step of the adsorption process. Under the conventional system, without some method of rejecting desorbent material from the recycled extract stream, the selective pore volume and desorbent requirements would continue to progressively increase.

Most moving bed adsorption processes also use a desorbent material that has a different composition than the primary components in the feed stream to the adsorption section. As a result the desorbent material is typically recovered from the raffinate material that it has desorbed for reuse in the adsorption section. It has been the usual practice to use a raffinate column to separate the desorbent material from the raffinate stream.

It is an object of this invention to simplify the adsorption section of a combination adsorption and isomerization process.

It is a further object of this invention to increase the octane number of a product stream that can be obtained from a combination of an isomerization process and adsorptive separation section for the production of high octane gasoline blending components.

It is a yet further object of this invention to make processes for the isomerization of hydrocarbons and the liquid phase adsorptive separation of isomerization effluents more economical.

Another object of this invention is to reduce the necessary equipment for the liquid phase adsorptive separation of normal and isoparaffins.

Another object of this invention is to provide a more cost effective arrangement for an isomerization of normal paraffins and the recycle of normal paraffins using liquid phase adsorptive separations.

SUMMARY OF THE INVENTION

Applicants have discovered that the combination of an isomerization zone for the isomerization of $C_5$–$C_6$ paraffins and an adsorptive separation section for the recycle of low octane paraffins to the isomerization section can be operated with a single fractionation column for the separation of raffinate, extract, product, desorbent and heavier hydrocarbon components. In broad terms the invention is an arrangement for a combination of an isomerization section for the isomerization of $C_5$ and $C_6$ paraffins and an adsorptive separation section for the separation of the isomerization zone effluent. This arrangement is structured such that the effluent from the isomerization zone enters an adsorption section that separates the effluent into a raffinate stream and an extract stream by contact of the effluent with an adsorbent and desorbs the adsorbed components from the adsorbent using a desorbent material. The raffinate from the adsorption section and a normal hexane stream enter a deisohexanizer that supplies an overhead isomerate product stream, a bottoms stream of heavy hydrocarbons and a sidecut stream of desorbent material comprising normal hexane. Any excess desorbent and extract from the adsorption section are recycled and combined with the feed entering the isomerization zone. The direct recycle of extract from the adsorption section to the isomerization zone, the transfer of the raffinate to the deisohexanizer column and the recovery of desorbent from the deisohexanizer eliminates the need for separate raffinate and extract columns as are typically used in the prior art. It has also been surprisingly found that this arrangement will increase the octane of the isomerate product recovered overhead from the deisohexanizer. The octane increase is the result of the recovery of monomethylpentanes with the desorbent material as it is removed from the deisohexanizer column. The monomethylpentanes are thereby recycled through the isomerization zone and converted to higher octane isomers. As a result, this invention has the advantage of simplifying the facilities for an isomerization adsorption section combination while also increasing the octane number of the product that is obtained therefrom.

Accordingly in a broad embodiment, this invention is a process for the isomerization of a feedstream comprising $C_5$–$C_6$ hydrocarbons. This process separates the feedstream comprising $C_5$ and $C_6$ hydrocarbons into a first stream comprising normal $C_6$ and higher boiling hydrocarbons and a second stream comprising the lower boiling components of the feedstream. A combination of the second stream and an extract stream provides a combined feed which passes into an isomerization zone containing an isomerization catalyst at isomerization conditions to isomerize the hydrocarbons in the second stream and recover an isomerization zone effluent from the isomerization zone that comprises $C_5$ and $C_6$ isoparaffins. At least a portion of the effluent passes from the isomerization zone to an adsorption section where it contacts an adsorbent that selectively adsorbs normal paraffins from the effluent and produces a raffinate stream having a decreased concentration of at least one normal paraffin component relative to the effluent stream and an adsorbent material having normal paraffins adsorbed thereon. At least a portion of the raffinate stream and the first stream pass into a fractionation column. Hydrocarbons having boiling points greater than normal hexane are withdrawn from the bottom of the fractionation zone. An isomerate product is withdrawn from the top of the fractionation zone. A sidecut stream comprising normal hexane is withdrawn from the fractionation zone. The desorbent stream passes to the adsorption zone where it contacts an adsorbent material having normal paraffins adsorbed thereon to desorb at least one normal paraffin component and produce the extract stream.

In another embodiment, this invention is a process for the isomerization of a $C_5+$ naphtha feedstream comprising $C_5$–$C_6$ hydrocarbons. The process separates the feedstream in a splitter column into a first stream comprising normal hexane and higher boiling hydrocarbons and a second stream comprising a lower boiling component from the feedstream. The combination of the second stream with an extract stream and a desorbent stream produce a combined feed that passes into an isomerization zone containing an isomerization catalyst at isomerization conditions to isomerize the hydrocarbons in the combined feed. An isomerization zone effluent ent comprising $C_5$ and $C_6$ isoparaffins is recovered from the isomerization zone. $C_4$ and lower boiling hydrocarbons are separated from the effluent stream which is then passed to a simulated moving bed adsorption section as an adsorber feed. Normal pentane is separated from the adsorber feed by maintaining a net fluid flow through at least three operationally distinct and serially interconnected zones of adsorbent in the adsorption section. One zone is an adsorption zone defined by the adsorbent located between a feed input stream at an upstream boundary of the adsorption zone and a raffinate output stream at a downstream boundary of the adsorption zone. Another zone is a purification zone defined by the adsorbent located between an extract output stream at an upstream boundary of the purification zone and the feed input stream at a downstream boundary of the purification zone. And the third zone is a desorption zone located immediately upstream from the purification zone that is defined by the adsorbent located between a desorbent input stream at an upstream boundary of the zone and the extract output stream at a downstream boundary of the zone. The adsorber feed is passed into the adsorption zone at adsorption conditions to effect the selective adsorption of the normal pentane by the adsorbent in the adsorption zone and withdrawing a raffinate output stream from the adsorption zone. At least a portion of the desorbent stream is passed into the desorption zone at desorption conditions to effect the displacement of normal pentane from the adsorbent in the desorption zone. An extract output stream comprising normal paraffins and desorbent is withdrawn from the desorption zone. A raffinate output stream comprising isoparaffins and desorbent is withdrawn from the adsorption zone. Periodically the feed input stream, raffinate output stream, desorbent input stream and extract output stream input points are advanced periodically through the column of adsorbent in a downstream direction with respect to fluid flow in the adsorption zone to effect the shifting of zones through the adsorbent and the production of extract output and raffinate output streams. At least a portion of the raffinate output stream is passed into an upper half of a fractionation column and at least a portion of the first stream is passed into a lower half of the fractionation column. A heavy hydrocarbon stream having a boiling point greater than normal hexane is withdrawn from the bottom of the fractionation column and an isomerate product stream is withdrawn from the top of the fractionation column. The isomerate product stream is essentially free of normal hexane and higher boiling hydrocarbons. A desorbent stream is withdrawn as a sidecut from the fractionation column at a tray location intermediate the column locations where the first stream and raffinate stream enter the column.

Other objects, embodiments, and aspects of this invention are described in the following detailed description of the invention.

BRIEF DESCRIPTION OF THE DRAWING

The figure is a schematic diagram of a flow arrangement for a combination isomerization and adsorption process arranged in accordance with this invention.

DETAILED DESCRIPTION OF THE INVENTION

This invention uses the combination of an isomerization zone and an adsorptive separation section. The invention is not restriced to any particular type of isomerization zone or adsorption section. The isomerization zone can consist of any type of isomerization zone that takes a stream of $C_5$–$C_6$ straight chain hydrocarbons or a mixture of straight chain and branched chain hydrocarbons and converts straight chain hydrocarbons in the feed mixture to branched chain hydrocarbons and branched hydrocarbons to more highly branched hydrocarbons thereby producing an effluent having branched chain and straight chain hydrocarbons. The adsorption sections is preferably liquid phase and can utilize any type of well known adsorption process such as a swing bed, simulated moving bed, or other schemes for contacting the adsorbent with the feed mixture and desorbing the feed mixture from the adsorbent with the desorbent material.

Suitable feedstocks for this process will include $C_5$ and $C_6$ hydrocarbons. At minimum the feed will include normal hexane and normal pentane. The typical feed for this process will be a naphtha feed with an initial boiling point in the range of normal butane. The feedstocks that can be used in this invention include hydrocarbon fractions rich in $C_4$–$C_6$ normal paraffins. The term "rich" is defined as a stream having more than 50% of the mentioned component. Preferred feedstocks are substantially pure normal paraffin streams having from 4–6 carbon atoms or a mixture of such substantially pure normal paraffins. It is also preferred that the feed contain at least 10% and preferably at least 20% normal pentanes. Another requirement of the feed is that it contain enough normal hexane to supply the desorbent requirements of this invention. Useful feedstocks include light natural gasoline, light straight-run naphtha, gas oil condensates, light raffinates, light reformate, light hydrocarbons, and straight-run distillates having distillation end points of about 77° C. (170° F.) and containing substantial quantities of $C_4$–$C_6$ paraffins. The feed may also contain low concentrations of unsaturated hydrocarbons and hydrocarbons having more than 6 carbon atoms. The concentration of these materials should be limited to 10 wt. % for unsaturated compounds and 20 wt. % for heavier hydrocarbons in order to restrict hydrogen consumption in cracking reactions. The feed in any normal paraffin recycle are combined and typically enter the isomerization zone with a hydrogen recycle stream.

This application is described with reference to FIG. 1. Reference to the specific arrangement for this invention is not meant to limit it to the details disclosed therein. Furthermore, FIG. 1 is a schematic illustration and does not show a number of details for the process arrangement such as pumps, compressors, valves, stabilizers and recycle lines which are well known to those skilled in the art.

The process begins by separating normal hexane and higher boiling hydrocarbons in the feed from hydrocarbons boiling below normal hexane. FIG. 1 shows an arrangement wherein a $C_5$+ naphtha is charged by line 10 to a naphtha splitter column 12. The naphtha splitter separates isohexane and lower boiling hydrocarbons from normal hexane and higher boiling hydrocarbons. Normal hexane and higher boiling hydrocarbons are taken by line 14 to a fractionation zone in the form of a deisohexanizer column 16. A line 18 carries the isohexane and lower boiling hydrocarbons overhead from naphtha splitter 12. Naphtha splitter column 12 is not an essential part of this invention but will be used in most arrangements when processing a combined normal pentane and normal hexane feed. The splitter column is often used since a substantial quantity of the normal hexane that is charged to the process must be available for withdrawal as desorbent from the fractionation zone. Thus, it is important that a substantial quantity of normal hexane be present in the deisohexanizer column. The presence of the substantial amounts of normal hexane in the deisohexanizer column is necessary to supply the desorbent needs as hereinafter explained. The splitter column 12 will usually be present to prevent all of the normal hexane from being charged first to the isomerization zone which may convert too high a quantity of the normal hexane to lower boiling isomers and leave an inadequate amount of normal hexane available in the fractionation column for withdrawal as desorbent. In addition the charging of large amounts of unconverted normal hexane through the adsorption section may unnecessarily increase the flowrate through the adsorption section. Of course, in certain situations where a separate stream of normal hexane is available, the process may be operated without a splitter.

The isohexane and lower boiling hydrocarbon stream carried by line 18 is mixed with an extract stream from the adsorption section carried by a line 20. The extract stream can be taken directly from the adsorption section and combined with the isomerization feed without intermediate separation. The extract stream will contain normal hexane and lower boiling hydrocarbons made up primarily of normal paraffins and monomethylbranched paraffins. In addition to the normal hexane, the other hydrocarbons in the extract stream will usually be normal pentane and monomethylpentanes. Therefore, all of the hydrocarbon components in the extract stream are susceptible to octane improvement by further processing through the isomerization zone. In some cases there will be an excess of desorbent that is withdrawn from the fractionation column. This excess is also combined with the feed to the isomerization zone. In the arrangement of FIG. 1, excess desorbent is carried by line 22 and combined with the extract and feed from lines 20 and 18, respectively, to form a combined feed carried by line 24 to isomerization zone 26.

Hydrogen is admixed with the feed to the isomerization zone in an amount that will provide a hydrogen to hydrocarbon molar ratio of from 0.01 to 10 in the effluent from the isomerization zone. Preferably, the hydrogen to hydrocarbon ratio is in the range of 0.05 to 5. Although no net hydrogen is consumed in the isomerization reaction, the isomerization zone will have a net consumption of hydrogen often referred to as the stoichiometric hydrogen requirement which is associated with a number of side reactions that occur. These side reactions include saturation of olefins and aromatics, cracking and disproportionation. For feeds having a high level of unsaturates, satisfying the stoichiometric hydrogen will require a higher hydrogen to hydrocarbon ratio for the feed at the inlet of the isomerization zone. Hydrogen in excess of the stoichiometric amounts for the side reactions is often maintained in the reaction zone to provide stability and conversion by compensating for variation in feed stream compositions that alter the stoichiometric hydrogen requirements. Higher hydrogen to hydrocarbon ratios are often used to prolong catalyst life by suppressing side reactions such as cracking and disproportionation. When such side reactions occur, they can reduce conversion and lead to formation of carbonaceous compounds, usually referred to as coke, that foul the catalyst.

It has recently been found that the hydrogen to hydrocarbon ratio in isomerization zones that use a chlorided platinum alumina catalyst can be reduced significantly. In such cases, it is desirable to reduce the amount of hydrocarbon that enters the isomerization zone such that the hydrogen to hydrocarbon ratio of the effluent from the isomerization zone is less than 0.05. Reduced hydrogen to hydrocarbon ratios have been used based on the finding that the amount of hydrogen needed for suppressing coke formation need not exceed dissolved hydrogen levels. The amount of hydrogen in solution at the normal conditions of the isomerization zone effluent are preferably in a ratio of from 0.02 to 0.01. The amount of excess hydrogen over the stoichiometric requirement that is required for good stability and conversion is in a ration of 0.01 to less than 0.05.

When the hydrogen to hydrocarbon ratio exceeds 0.05, it is not economically desirable to operate the isomerization zone without the recycle of hydrogen to the isomerization zone. Therefore, in such cases, recovery facilities for hydrogen from the effluent will be provided as hereinafter described. Hydrogen may be added to the feed mixture in any manner that provides the necessary control for the addition of the hydrogen.

The hydrogen and hydrocarbon feed mixture is contacted in the reaction zone with an isomerization catalyst. The catalyst composites that can be used in the isomerization zone include traditional isomerization catalysts. Such catalysts include high chloride catalyst on an alumina base containing platinum, and crystalline aluminosilicates or crystalline zeolites. Suitable catalyst compositions of this type will exhibit selective and substantial isomerization activity under the operating conditions of the process.

The preferred isomerization catalyst for this invention is a chlorided platinum alumina catalyst. The aluminum is preferably an anhydrous gamma-alumina with a high degree of purity. The catalyst may also contain other platinum group metals. The term platinum group metals refers to noble metals excluding silver and gold which are selected from the group consisting of platinum, palladium, germanium, ruthenium, rhodium, osmium, and iridium. These metals demonstrate differences in activity and selectivity such that platinum has now been found to be the most suitable for this process. The catalyst will contain from about 0.1 to 0.25 wt. % of the platinum. Other platinum group metals may be present in a concentration of from 0.1 to 0.25 wt. %. The platinum component may exist within the final catalytic composite as an oxide or halide or as an elemental metal. The presence of the platinum component in its reduced state has been found most suitable for this process. The chloride component termed in the art "a combined chloride" is present in an amount from about 2 to about 10 wt. % based upon the dry support material. The use of chloride in amounts greater than 5 wt. % have been found to be the most beneficial for this process. The inorganic oxide preferably comprises alumina and more preferably gamma-alumina, eta-alumina, and mixtures thereof.

There are a variety of ways for preparing the catalytic composite and incorporating the platinum metal and the chloride therein. The method that has shown the best results in this invention prepares the catalyst by impregnating the carrier material through contact with an aqueous solution of a water-soluble decomposable compound of the platinum group metal. For best results, the impregnation is carried out by dipping the carrier material in a solution of chloroplatinic acid. Additional solutions that may be used include ammonium chloroplatinate, bromoplatinic acid or platinum dichloride. Use of the platinum chloride compound serves the dual function of incorporating the platinum component and at least a minor quantity of the chloride into the catalyst. Additional amounts of halogen must be incorporated into the catalyst by the addition or formation of aluminum chloride to or on the platinum-aluminum catalyst base. An alternate method of increasing the halogen concentration in the final catalyst composite is to use an aluminum hydrosol to form the aluminum carrier material such that the carrier material also contains at least a portion of the chloride. Halogen may also be added to the carrier material by contacting the calcined carrier material with an aqueous solution of the halogen acid such as hydrogen chloride.

It is generally known that high chlorided platinum-alumina catalysts of this type are highly sensitive to sulfur and oxygen-containing compounds. Therefore, the use of such catalysts requires that the feedstock be relatively free of such compounds. A sulfur concentration no greater than 0.5 ppm is generally required. The presence of sulfur in the feedstock serves to temporarily deactivate the catalyst by platinum poisoning. Activity of the catalyst may be restored by hot hydrogen stripping of sulfur from the catalyst composite or by lowering the sulfur concentration in the incoming feed to below 0.5 ppm so that the hydrocarbon will desorb the sulfur that has been adsorbed on the catalyst. Water can act to permanently deactivate the catalyst by removing high activity chloride from the catalyst and replacing it with inactive aluminum hydroxide. Therefore, water, as well as oxygenates, in particular $C_1$–$C_5$ oxygenates, that can decompose to form water, can only be tolerated in very low concentrations. In general, this requires a limitation of oxygenates in the feed to about 0.1 ppm or less. The feedstock may be treated by any method that will remove water and sulfur compounds. Sulfur may be removed from the feed stream by hydrotreating. A variety of commercial dryers are available to remove water from the feed components. Adsorption processes for the removal of sulfur and water from hydrocarbon streams are also well known to those skilled in the art.

As a class, the crystalline aluminosilicate or crystalline zeolite catalysts comprise crystalline zeolitic molecular sieves having an apparent pore diameter large enough to adsorb neopentane. A silica alumina molar ratio $SiO_2$:$Al_2O_3$ of greater than 3; less than 60 and preferably between 15 and 30 is desirable. In preferred form, the zeolite will contain an equivalent percent alkali metal cations and will have those $AlO_4$-tetrahedra not associated with alkali metal cations; either not associated with any metal cations or associated with divalent or other polyvalent metal cations. Usually the molecular sieve is a mordenite molecular sieve which is essentially in the acid form or is converted to the acid form. Particularly preferred catalysts of this type for isomerization are disclosed in detail in U.S. Pat. Nos. 3,442,794 and 3,836,597.

A preferred composition of zeolitic catalyst for use in the present invention comprises a Group VIII noble metal, a hydrogen form crystalline aluminosilicate, and a refractory inorganic oxide with the catalyst composition having a surface area of at least 580 $m^2/g$. Significant improvements in isomerization performance are realized when the surface area of the catalytic composite is at or above 580 $m^2/g$. A Group VIII metal is incorporated into the catalytic composite to supply a hydrogenation/dehydrogenation function and the preferred Group VIII noble metal is platinum. The Group VIII noble metal is present in an amount from about 0.01 to 5% by weight of the composite and preferably in an amount of at least 0.15% by weight but not over 0.35% by weight. The zeolitic catalytic composite may also contain a catalytically effective amount of a promoter metal such as tin, lead, germanium, cobalt, nickel, iron, tungsten, chromium, molybdenum, bismuth, indium, gallium, cadmium, zinc, uranium, copper, silver, gold, tantalum, or one or more of rare earth metals and mixtures thereof. The hydrogen-formed silica alumina has either a three-dimensional or channel pore structure crystal lattice framework. The three-dimensional aluminosilicates include both synthetic and naturall occurring silica aluminas such as faujasites, which include X-type, Y-type, ultrastable-Y, and the like. L-type, omega-type, and mordenite are examples of the channel pore structure crystalline aluminosilicates. Mordenite, in either naturally occurring or synthetic form are preferred, particularly with a silica to alumina ratio of at least 16:1. The hydrogen form aluminosilicate may be present in an amount within the range of 50 to about 99.5 wt. %, preferably within the range of 75 to about 95 wt. %, and a refractory inorganic oxide may be present in an amount within the range of from 25 to about 50 wt. %.

Operating conditions within the isomerization zone are selected to maximize the production of isoalkane product from the feed components. Temperatures within the reaction zone will usually range from about 40°–320° C. (100°–600°F.). Lower reaction temperatures are generally preferred since they usually favor equilibrium mixtures of isoalkanes versus normal alkanes. Lower temperatures are particularly useful in processing feeds composed of $C_5$ and $C_6$ alkanes where the lower temperatures favor equilibrium mixtures having the highest concentration of the most branched isoalkanes. When the feed mixture is primarily $C_5$ and $C_6$ alkanes temperatures in the range of from 60° to 160° C. are preferred. Higher reaction temperatures increase catalyst activity and promote the isomerization of $C_4$ hydrocarbons. The reaction zone may be maintained over a wide range of pressures. Pressure conditions in the isomerization of $C_4$–$C_6$ paraffins range from 700 to 7000 Kpag. Preferred pressures for this process are in the range of from 2000 to 3000 Kpag. The feed rate to the reaction zone can also vary over a wide range. These conditions include liquid hourly space velocities ranging from 0.5 to 12 $hr.^{-1}$, however, space velocities between 1 and 6 $hr.^{-1}$ are preferred. The isomerization zone will usually operate at a LHSV of about 1.5.

Operation of the reaction zone with the preferred chlorided platinum-alumina catalyst also requires the presence of a small amount of an organic chloride promoter. The organic chloride promoter serves to maintain a high level of active chloride on the catalyst as low levels are continuously stripped off the catalyst by the hydrocarbon feed. The concentration of promoter in the reaction zone is maintained at from 30 to 300 ppm. The preferred promoter compound is carbon tetrachloride. Other suitable promoter compounds include oxygen-free decomposable organic chlorides such as propyldichloride, butylchloride, and chloroform to name only a few of such compounds. The need to keep the reactants dry is reinforced by the presence of the organic chloride compound which converts to hydrogen chloride. As long as the process streams are kept dry, there will be no adverse effect from the presence of hydrogen chloride.

The isomerization zone usually includes a two-reactor system with a first stage reactor and a second stage reactor in the reaction zone. The catalyst used in the process is distributed equally between the two reactors. It is not necessary that the reaction be carried out in two reactors but the use of two reactors confer several benefits on the process. The use of two reactors and specialized valving allows partial replacement of the catalyst system without taking the isomerization unit off stream. For the short periods of time during which replacement of catalyst may be necessary, the entire flow of reactants may be processed through only one reaction vessel while catalyst is replaced in the other. The use of two reaction zones also aids in maintaining lower catalyst temperatures. This is accomplished by having any exothermic reaction such as hydrogenation of unsaturates performed in a first reaction vessel with the rest of the reaction carried out in a final reaction vessel at more favorable temperature conditions.

The effluent from the reactors enters a stabilizer that removes light gases and butane from the effluent (not shown). The amount of butane taken off from the stabilizer will vary depending upon the amount of butane entering the process. The stabilizer normally runs at a pressure of from 800 to 1700 Kpaa.

When the isomerization zone is operated with a high hydrogen to hydrocarbon ratio, a separator is usually placed ahead of the stabilizer. A hydrogen-rich recycle gas stream is recovered from the separator and recycled for combination with the feed entering the isomerization zone. When the isomerization zone operates with very low hydrogen to hydrocarbon ratios the separator is not needed and the effluent from the isomerization zone may enter the stabilizer directly.

The bottoms stream from the stabilizer provides an isomerization zone effluent stream comprising $C_5$ and higher boiling hydrocarbons that include normal paraffins for recycle and isoparaffin products. The chlorides which may be present in the reaction zone will usually pose no problem for the sorbent in the adsorption zone. In normal operation, any chlorides that are present in the effluent from the isomerization zone will be removed in the overhead from the stabilizer. However, where the isomerization zone or separators downstream from the isomerization are subject to upsets, it may be desirable to provide a guard bed of some type to treat the stabilizer bottoms and prevent any carryover of chloride compounds into the adsorption section.

The isomerization effluent is taken by line 28 and enters the adsorption section 30 where it is contacted with an adsorbent in an adsorption zone. The adsorption section of this invention is operated to primarily remove the normal pentane fraction from the effluent of the isomerization zone. This process is especially suited for adsorption systems that use multiple ports for supplying the process streams to the adsorbent and divide the adsorbent into a plurality of zones for adsorbing normal paraffins, recovering isoparaffins, purifying the adsorbent, and desorbing the normal paraffins. A well-known process of this type is the simulated countercurrent moving bed system for simulating moving bed countercurrent flow systems. Such systems have a much greater separation efficiency than fixed molecular sieve bed systems. In the moving bed or simulated moving bed processes, the retention and displacement operations are continuously taking place which allows both continuous production of an extract and a raffinate stream and the continual use of feed and desorbent streams. One preferred embodiment of this process utilizes what is known in the art as the simulated moving bed countercurrent flow system. The operating principles and sequence of such flow system are described in U.S. Pat. No. 2,985,589 incorporated herein by reference. In such a system it is the progressive movement of multiple liquid access points down a molecular sieve chamber that simulates the upward movement of molecular sieve contained in the chamber.

A number of specially defined terms are used in describing the simulated moving bed processes. The term "feed stream" indicates a stream in the process through which feed material passes to the molecular sieve. A feed material comprises one or more extract components and one or more raffinate components. An "extract component" is a compound or type of compound that is more selectively retained by the molecular sieve while a "raffinate component" is a compound or type of compound that is less selectively retained. In this process normal hydrocarbons from the feed stream are extract components while feed stream branched chain and cyclic hydrocarbons are raffinate components. The term "extract component" as used herein refers to a more selectively retained compound such as normal hydrocarbons in this process. The term "displacement fluid" "or desorbent" shall mean generally a material capable of displacing an extract component. The term "desorbent" or "desorbent input stream" indicates the stream through which desorbent passes to the molecular sieve. The term "raffinate output stream" means a stream through which most of the raffinate components are removed from the molecular sieve. The composition of the raffinate stream can vary from about 100% desorbent to essentially 100% raffinate components. The term "extract stream" or "extract output stream" means a stream through which an extract material which has been displaced by a desorbent is removed from the molecular sieve. The composition of the extract stream can also vary from about 100% desorbent to essentially 100% extract components.

The term "selective pore volume" of the molecular sieve is defined as the volume of the molecular sieve which selectively retains extract components from the feedstock. The term "non-selective void volume" of the molecular sieve is the volume of the molecular sieve which does not selectively retain extract components from the feedstock. This non-selective void volume includes the cavities of the molecular sieve which are not capable of retaining extract components and the interstitial void spaces between molecular sieve particles. The selective pore volume and the non-selective void volume are generally expressed in volumetric quantities and are of importance in determining the proper flow rates of fluid required to be passed into an operational zone for efficient operations to take place for a given quantity of molecular sieve.

When molecular sieve "passes" into an operational zone (hereinafter defined and described) its non-selective void volume together with its selective pore volume carries fluid into that zone. The non-selective void volume is utilized in determining the amount of fluid which should pass into the same zone in a countercurrent direction to the molecular sieve to displace the fluid present in the non-selective void volume. If the fluid flow rate passing into a zone is smaller than the non-selective void volume rate of molecular sieve material passing into that zone, there is a net entrainment of liquid into the zone by the molecular sieve. Since this net entrainment is a fluid present in non-selective void volume of the molecular sieve, it, in most instances, comprises less selectively retained feed components.

In the preferred simulated moving bed process only four of the access lines are active at any one time: the feed input stream, displacement or desorbent fluid inlet stream, raffinate outlet stream, and extract outlet stream access lines. Coincident with this simulated upward movement of the solid molecular sieve is the movement of the liquid occupying the void volume of the packed bed of molecular sieve. So that countercurrent contact is maintained, a liquid flow down the molecular sieve chamber may be provided by a pump. As an active liquid access point moves through a cycle, that is, from the top of the chamber to the bottom, the chamber circulation pump moves liquid through different zones which require different flow rates. A programmed flow controller may be provided to set and regulate these flow rates.

The active liquid access points effectively divide the molecular sieve chamber into separate zones, each of which has a different function. In this embodiment of the process, it is generally necessary that three separate operational zones be present in order for the process to take place although in some instances an optional fourth zone may be used.

The retention or extract zone, zone 1, is defined as the molecular sieve located between the feed inlet stream and the raffinate outlet stream. In this zone, the feedstock contacts the molecular sieve, an extract component is retained, and a raffinate stream is withdrawn. Since the general flow through zone 1 is from the feed stream which passes into the zone to the raffinate stream which passes out of the zone, the flow in this zone is considered to be a downstream direction when proceeding from the feed inlet to the raffinate outlet streams.

Immediately upstream with respect to fluid flow in zone 1 is the purification zone, zone 2. The purification zone is defined as the molecular sieve between the extract outlet stream and the feed inlet stream. The basic operations taking place in zone 2 are the displacement from the non-selective void volume of the molecular sieve of any raffinate material carried into zone 2 by the shifting of molecular sieve into this zone and the displacement of any raffinate material retained within the selective pore volume of the molecular sieve. Purification is achieved by passing a portion of extract stream material leaving zone 3 into zone 2 at zone 2's upstream boundary to effect the displacement of raffinate material. The flow of material in zone 2 is in a downstream direction from the extract outlet stream to the feed inlet stream.

Immediately upstream of zone 2 with respect to the fluid flowing in zone 2 is the displacement or desorption zone, zone 3. The desorption zone is defined as the molecular sieve between the desorption inlet and the extract outlet stream. The function of the desorption zone is to allow a desorbent which passes into this zone to displace the extract component which was retained in the molecular sieve during a previous contact with feed in zone 1 in a prior cycle of operation. The flow of fluid in zone 3 is essentially in the same direction as that of zones 1 and 2.

In some instances, an optional buffer zone, zone 4, may be utilized. This zone, defined as the molecular sieve between the raffinate outlet stream and the desorbent inlet stream, if used, is located immediately upstream with respect to the fluid flow to zone 3. Zone 4 would be utilized to conserve the amount of desorbent utilized in the desorption step since a portion of the raffinate stream which is removed from zone 1 can be passed into zone 4 to displace desorbent present in that zone out of the zone into the desorption zone. Zone 4 will contain enough desorbent so that raffinate material present in the raffinate stream passing out of zone 1 and into zone 4 can be prevented from passing into zone 3 thereby contaminating extract stream removed from zone 3. In the instances in which the fourth operational zone is not utilized, the raffinate stream passed from zone 1 to zone 4 must be carefully monitored in order that the flow directly from zone 1 to zone 3 can be stopped when there is an appreciable quantity of raffinate material present in the raffinate stream passing from zone 1 into zone 3 so that the extract outlet stream is not contaminated.

A cyclic advancement of the input and output streams through the fixed bed of molecular sieve can be accomplished by utilizing a manifold system in which the valves in the manifold are operated in a sequential manner to effect the shifting of the input and output streams thereby allowing a flow of fluid with respect to solid molecular sieve in a countercurrent manner. Another mode of operation which can effect the countercurrent flow of solid molecular sieve with respect to fluid involves the use of a rotating disc valve in which the input and output streams are connected to the valve and the lines through which feed input, extract output, displacement fluid input and raffinate output streams pass are advanced in the same direction through the molecular sieve bed. Both the manifold arrangement and disc valve are known in the art. Specifically rotary disc valves which can be utilized in this operation can be found in U.S. Pat. Nos. 3,040,777 and 3,422,848, incorporated herein by reference. Both of the aforementioned patents disclose a rotary type connection valve in which the suitable advancement of the various input and output streams from fixed sources can be achieved without difficulty.

In many instances, one operational zone will contain a much larger quantity of molecular sieve than some other operational zone. For instance, in some operations, the buffer zone can contain a minor amount of molecular sieve as compared to the molecular sieve required for the retention and purification zones. It can also be seen that in instances in which desorbent is used which can easily displace extract material from the molecular sieve that a relatively small amount of molecular sieve will be needed in a desorption zone as compared to the molecular sieve needed in the retention zone or purification zone. Since it is not required that the molecular sieve be located in a single column, the use of multiple chambers or a series of columns is within the scope of the invention.

It is not necessary that all of the input or output streams be simultaneously used, and in fact, in many instances some of the streams can be shut off while others effect an input or output of material. The apparatus which can be utilized to effect the process of this invention can also contain a series of individual beds connected by connecting conduits upon which are placed input or output taps to which the various input or output streams can be attached and alternately and periodically shifted to effect continuous operation. In some instances, the connecting conduits can be connected to transfer taps which during the normal operations do not function as a conduit through which material passes into or out of the process.

Reference can be made to D. B. Broughton U.S. Pat. No. 2,985,589, and to a paper entitled "Continuous Adsorptive Processing—A New Separation Technique" by D. B. Broughton presented at the 34th Annual Meeting of the Society of Chemical Engineers at Tokyo, Japan on Apr. 2, 1969, both references incorporated herein by reference, for further explanation of the simulated moving bed countercurrent process flow scheme.

Although both liquid and vapor phase operations can be used in many adsorptive type separation processes, liquid-phase operation is preferred for this process because of the lower temperature requirements and because of the higher yields of extract product that can be obtained with liquid-phase operation over those obtained with vapor-phase operation. Extract conditions will, therefore, include a pressure sufficient to maintain liquid phase. Desorption conditions will include the same range of temperatures and pressures as used for extract conditions.

In the operation of this process, at least a portion of the raffinate output stream will be passed directly to a fractionation zone. The fractionation zone will typically be a single fractionation column, the general design and operation of which is well known to the separation art. In the Figure a line 32 passes the raffinate directly to deisohexanizer 16.

The fractionation zone serves a variety of purposes. It provides an overhead product stream that contains a high concentration of isopentane and dimethylbutanes. Typically, the research octane number of the product stream will be between 91 and 94. The isomerate product stream also contains low concentrations of normal pentane, normal hexane and monomethylpentanes. These relatively lower octane hydrocarbons are reduced by the operation of the adsorption section which preferentially adsorbs normal pentane and directly recycles the normal pentanes to the isomerization zone in the extract stream and the withdrawal of normal hexane and monomethylpentanes in large amounts from the fractionation zone for use as a desorbent material in the adsorption section which also eventually is recycled to isomerization zone. The desorbent is preferably removed as a sidecut from a single fractionation column. In FIG. 1, line 36 is shown as a sidecut stream from the deisohexanizer column 16. Desorbent can be withdrawn from any point below the input point of line 32. Thus, the raffinate stream can be withdrawn from below the input point for line 14. The Figure shows the preferred withdrawal point for sidecut stream 36 which is between the input point for the raffinate stream carried by line 32 and the input point for the normal hexane and higher boiling hydrocarbon stream carried by line 14. In the operation of a fractionation zone having the arrangement of deisohexanizer 16, normal hexane drops down the column from the inlet of line 32 and rises up the column from the inlet of line 14. The location of normal hexane input points above and below the withdrawal point for sidecut 36 provides a stream that is rich in normal hexane as well as closely boiling monomethylpentanes that are carried over into the sidecut stream. The withdrawal of the desorbent as a liquid sidecut from the deisohexanizer has the advantage of disengaging desorbent from the raffinate stream at very low utility cost.

Heavier hydrocarbons are withdrawn from the fractionation column as a heavy hydrocarbon stream. For the single column deisohexanizer, this heavy hydrocarbon stream is withdrawn by a line 38. Where a full boiling range naphtha is used as the feed to the process, the heavy hydrocarbon feed will comprise a $C_7+$ naphtha. This bottoms stream will ordinarily be used as the feed in a reforming zone.

Line 36 provides a desorbent for the adsorption section that is passed from line 36 to the adsorption section by a line 40. Depending on the conditions in the adsorption section and the isomerization zone, the amount of the desorbent available through line 36 may exceed that needed for the adsorption section. This excess desorbent is diverted from line 36 to the previously described line 22 and enters the isomerization zone directly as part of the isomerization zone feed.

Excess desorbent in line 36 is present in the deisohexanizer as part of the normal hexane that has been charged to the fractionation zone. Although it may be possible to eliminate the excess desorbent from the fractionation zone by changing the operation of a splitter column when one is provided, it is usually desirable to have the excess desorbent in the fractionation zone in order to improve the carryover of monomethylpentanes into the isomerization zone.

In this invention, the extract stream does not enter any separation section for the recovery of the displacement fluid. At least a portion of the extract stream is recycled directly to the isomerization zone to provide the recycle stream as previously described. The direct recycle of the extract stream eliminates the need for a separation column and the equipment associated therewith. The elimination of the separation column for the extract stream significantly reduces the cost of the adsorption section.

Prior art processes provided a column for the separation of desorbent from the extract stream in the belief that the process could not be economically operated without such a separation. In an adsorptive separation process, the amount of potentially adsorbed component in the feed that enters the adsorption zone will control the amount of selective pore volume that must be available in the adsorbent and the amount of the displacement fluid or desorbent that is needed to recover the adsorbed material from the adsorbent. Looking more specifically at the process for the separation of normal paraffins, the amount of normal paraffins in the feed mixture sets the amount of selective pore volume that must be available to process a given quantity of the feed mixture. In the case of a simulated moving bed process, an excess of adsorbent to the amount of normals in the feed mixture must be provided to adsorb all of the normals in the feed. In order to fully desorb all of the adsorbed components from the adsorbent, a large excess of displacement fluid or desorbent material is also needed. The circulation of the selective pore volume at a rate greater than the volumetric addition of normal paraffins and the circulation of desorbent at a rate greater than the circulation of the selective pore volume will not permit all of the desorbent material from the desorption zone to reenter the extract zone with the feed material unless there is a constantly increasing circulation of selective pore volume. Therefore, some removal of desorbent material from the extract stream is necessary in order to continuously operate the process with a constant circulation of selective pore volume. The recycle of the extract stream to the isomerization zone provides the necessary removal of desorbent material from the process. The amount of normal hexane desorbent present in the process is decreased by passing it through the isomerization zone. A further control on the amount of desorbent that is passed through the adsorption section is provided by diverting desorbent from the fractionation zone directly to the isomerization zone as previously described.

EXAMPLE

The ability of this isomerization zone and adsorption section combination to operate without extract or raffinate columns and provide a high octane isomerate product are demonstrated by the following example. This example consists of engineering calculations that are based on experience from the operation of similar components in commercial processing units. This example is arranged in accordance with the isomerization zone and adsorption section shown in the Figure and will be described using the reference numbers appearing therein. A $C_5+$ naphtha feed having the composition given in Table 1 for stream No. 10 is fed into a naphtha splitter at a temperature of 66° C. and a pressure of 700 Kpaa. Table 1 shows the flowrate of the various feed components into the naphtha splitter. The naphtha splitter is arranged with 40 trays and operates with a molar reflux to feed ratio of 0.6. A bottoms stream is taken from splitter 12 by line 14 at a temperature of 120° C. and a pressure of 280 Kpaa and transferred to deisohexanizer column 16. An overhead stream is taken by line 18 at a pressure of 250 Kpaa and a temperature of 60° C. The overhead and bottoms stream have a flowing composition as given in Table 1 under lines 18 and 14, respectively.

TABLE 1

| Flowing Composition, Vol. % Component | 10 | 14 | 18 | 24 | 20 | 22 | 28 | 32 | 34 | 38 | 36 |
|---|---|---|---|---|---|---|---|---|---|---|---|
| i-Butane | 0.06 | 0.00 | 0.35 | 0.10 | 0.01 | 0.00 | 0.32 | 0.27 | 0.60 | 0.00 | 0.00 |
| n-Butane | 0.77 | 0.00 | 4.20 | 1.40 | 0.42 | 0.00 | 0.57 | 0.25 | 0.56 | 0.00 | 0.00 |
| i-Pentane | 4.66 | 0.00 | 25.48 | 7.30 | 0.79 | 0.00 | 20.66 | 17.85 | 38.90 | 0.00 | 0.00 |
| n-Pentane | 8.81 | 0.00 | 48.18 | 18.86 | 8.92 | 0.00 | 6.42 | 0.29 | 0.62 | 0.00 | 0.00 |
| n-Hexane | 7.65 | 9.07 | 1.32 | 17.14 | 22.14 | 31.78 | 6.56 | 15.25 | 0.43 | 0.34 | 31.78 |
| 2-Me-Pentane | 4.15 | 2.84 | 9.99 | 15.58 | 17.59 | 17.73 | 16.80 | 16.98 | 13.88 | 0.00 | 17.73 |
| 3-Me-Pentane | 2.34 | 2.29 | 2.52 | 11.36 | 14.53 | 14.81 | 9.52 | 10.28 | 2.89 | 0.00 | 14.82 |
| 2,2-DiMe-Butane | 0.09 | 0.01 | 0.44 | 0.87 | 1.08 | 0.41 | 17.93 | 15.55 | 33.21 | 0.00 | 0.42 |
| 2,3-DiMe-Butane | 0.49 | 0.26 | 1.52 | 2.76 | 3.21 | 3.14 | 5.59 | 5.27 | 6.82 | 0.00 | 3.14 |
| Cyclopentane | 1.02 | 0.02 | 5.51 | 1.51 | 0.06 | 0.03 | 1.06 | 0.92 | 2.00 | 0.00 | 0.02 |
| Cyclohexane | 4.13 | 5.05 | 0.02 | 9.34 | 12.70 | 12.99 | 7.10 | 7.94 | 0.00 | 4.53 | 12.98 |
| Me-Cyclopentane | 3.79 | 4.59 | 0.24 | 11.25 | 15.20 | 15.66 | 6.09 | 7.44 | 0.10 | 0.33 | 15.63 |
| Benzene | 1.00 | 1.21 | 0.07 | 1.36 | 1.82 | 1.91 | 0.00 | 0.26 | 0.00 | 0.11 | 1.90 |
| Methane | 0.00 | 0.00 | 0.00 | 0.00 | 0.00 | 0.00 | 0.00 | 0.00 | 0.00 | 0.00 | 0.00 |
| Ethane | 0.00 | 0.00 | 0.00 | 0.00 | 0.00 | 0.00 | 0.00 | 0.00 | 0.00 | 0.00 | 0.00 |
| Propane | 0.03 | 0.00 | 0.15 | 0.04 | 0.00 | 0.00 | 0.00 | 0.00 | 0.00 | 0.00 | 0.00 |
| C7+ | 61.01 | 74.66 | 0.00 | 1.12 | 1.53 | 1.54 | 1.39 | 1.44 | 0.00 | 94.69 | 1.57 |
| Total | 100.00 | 100.00 | 100.00 | 100.00 | 100.00 | 100.00 | 100.00 | 100.00 | 100.00 | 100.00 | 100.00 |

The feed components carried by line 18 are combined with an extract stream, an excess desorbent stream carried by lines 20 and 22, respectively. The flowing compositions of lines 20 and 22 are given in the Table along with the flowing composition of a combined feed that enters an isomerization zone via line 24 at a temperature of 83° C. and a pressure of 250 Kpaa. In the isomerization zone, the combined feed is contacted with an isomerization catalyst that comprises a chlorided platinum-alumina catalyst at a liquid hourly space velocity of 1.5. As the combined feed enters the isomerization zone, it is combined with hydrogen in an amount to produce a hydrogen/hydrocarbon ratio of 0.05 at the outlet of the isomerization section. The isomerization section includes a two-reactor system that operates at a pressure of 3100 Kpaa. A stabilized effluent having the composition given for line 28 is recovered from the isomerization zone 26 and transferred as the feed to an adsorption section 30.

The adsorption section is arranged with an eight bed adsorption column filled with a zeolite adsorbent of the Ca-A type. The adsorption section operates at a cycle time of less than 60 minutes for a complete sequence of all the zones through the beds of adsorbent. An operating temperature of 93° C. (200° F.) and an operating pressure of 2760 Kpaa are maintained within the adsorption section. The extract stream taken by line 20 is withdrawn from the adsorption section along with a raffinate stream having the composition given in the Table under line 32. The raffinate stream is transferred without intermediate separation into the deisohexanizer column 16.

Deisohexanizer column 16 is arranged with 100 trays and operates with a molar reflux to net deisohexanizer overhead ratio of 4.0. The raffinate stream enters the deisohexanizer at tray level 20. The desorbent stream having a composition given under line 36 in the Table is withdrawn from the deisohexanizer as a sidecut at tray level 65. All of the desorbent taken by line 36 enters the adsorption section except for the amount of excess desorbent which is carried by line 22 as previously described. The previously described bottoms stream taken by line 14 enters the deisohexanizer column at tray level 85. A bottoms stream having the composition given for line 38 is withdrawn from the deisohexanizer column and used as the feed to a reforming process. The contents of line 38 are taken from the column at a temperature of 93° C. and a pressure of 480 Kpaa. The remaining column output is taken overhead by line 34.

Line 34 recovers an isomerate product stream having the composition given in Table 1. The contents of line 34 are recovered at a temperature of 38° C. and a pressure of 350 Kpa. The isomerate product has the properties given in Table 2.

TABLE 2

| | |
|---|---|
| RONC | 91.0 |
| MONC | 89.6 |
| RVP | 12.6 |

TABLE 2-continued

| | |
|---|---|
| S.G. | 0.6463 |

This example shows that the isomerate product has a high octane number, 3 to 5 octane numbers higher than that usually achievable with conventional recycle isomerization schemes. Therefore, the flow arrangement of this invention will improve the operation of an isomerization zone and adsorption section combination by increasing the octane of the isomerate obtained therefrom and simplifying the overall operation of the combination process.

What is claimed is:

1. A process for the isomerization of a feedstream comprising $C_5$–$C_6$ hydrocarbons said process comprising:

(a) separating said feedstream comprising $C_5$–$C_6$ hydrocarbons into a first stream comprising normal hexane and higher boiling hydrocarbons and a second stream comprising components from said feedstream boiling below normal hexane;

(b) combining said second stream with an extract stream to produce a combined feed and passing said combined feed into an isomerization zone containing an isomerization catalyst at isomerization conditions to isomerize the hydrocarbons in said second stream and recovering an isomerization zone effluent from said isomerization zone comprising $C_5$ and $C_6$ isoparaffins;

(c) passing at least a portion of the effluent from said isomerization zone to an adsorption section, contacting said effluent with an adsorbent, selectively adsorbing normal paraffins from said effluent, and producing a raffinate stream having a decreased concentration of at least one normal paraffin component relative to said effluent stream and a adsorbent material having normal paraffins adsorbed thereon;

d) passing at least a portion of said raffinate stream and said first stream into a fractionation zone, withdrawing hydrocarbons having boiling points greater than normal hexane from the bottom of said fractionation zone, recovering an isomerate product from an overhead of said fractionation zone and withdrawing a sidecut stream comprising normal hexane from said fractionation zone as a desorbent stream;

(e) passing said desorbent stream to said adsorption zone and contacting said adsorbent material having normal paraffins adsorbed thereon with said desorbent stream to desorb at least one normal paraffin component and produce said extract stream.

2. The process of claim 1 wherein said feedstream includes C7 and higher boiling hydrocarbons.

3. The process of claim 1 wherein said combined stream is formed by combining said extract stream and said second stream with a portion of said desorbent stream.

4. The process of claim 1 wherein said adsorption zone comprises a simulated moving bed adsorption zone.

5. The process of claim 1 wherein said isomerization effluent passes directly to a stabilizer, $C_4$ and lighter hydrocarbons are removed from said effluent and the remainder of the effluent is passed directly to said adsorption zone.

6. The process of claim 1 wherein the adsorbent in said adsorption zone comprises calcium zeolite A.

7. The process of claim 1 wherein said adsorption zone operates in liquid phase.

8. The process of claim 1 wherein said isomerization catalyst comprises alumina having from 0.01 to 0.25 wt. % platinum and from 2 to 10 wt. % of a chloride component.

9. The process of claim 4 wherein said adsorption section comprises at least one bed of adsorbent, the total quantity of adsorbent is divided into at least three operationally distinct zones of adsorbent, said effluent and desorbent are charged to different zones and the position of the zones relative to said total quantity of said adsorbent is at least intermittently varied by changing withdrawal and input points for said feed and desorbent.

10. The process of claim 1 wherein said fractionation zone comprises a single column, said first stream enters said column at a first inlet point lower elevation, said raffinate stream enters said column at a second inlet point located above said first inlet point and said sidecut is withdrawn from said column at an elevation between said first and second inlet points.

11. The process of claim 1 wherein said raffinate stream has a decreased concentration of normal pentane relative to said effluent stream.

12. The process of claim 1 wherein said desorbent stream comprises normal hexane and mono-methyl pentanes.

13. A process for the isomerization of a $C_5$+naphtha feedstream comprising $C_5$–$C_6$ hydrocarbons said process comprising:

(a) separating said feedstream in a splitter column into a first stream comprising normal hexane and higher boiling hydrocarbons and a second stream comprising components from said feedstream boiling below normal hexane;

(b) combining said second stream with an extract stream and a portion of a desorbent stream to produce a combined feed and passing said combined feed into an isomerization zone containing an isomerization catalyst and contacting said combined feed at isomerization conditions to isomerize the hydrocarbons in said second stream and recovering an isomerization zone effluent from said isomerization zone comprising $C_5$ and $C_6$ isoparaffins;

(c) separating $C_4$ and lower boiling hydrocarbons from said effluent stream;

(d) passing at least a portion of the effluent from said isomerization zone to a simulated moving bed adsorption zone, contacting said effluent with an adsorbent, selectively adsorbing normal paraffins from said effluent, and producing a raffinate stream having a reduced concentration of normal pentane relative to said effluent stream and an adsorbent material having normal pentane adsorbed thereon;

(e) passing at least a portion of said raffinate stream into an upper portion of a fractionation column, passing at least a portion of said first stream into a lower half of said fractionation column and withdrawing feedstream components having a boiling point greater than normal hexane from the bottom of said fractionation column, recovering an isomerate product stream from the top of said fractionation column, said isomerate product stream being essentially free of normal hexane and higher boiling hydrocarbons, and withdrawing said desorbent stream as a sidecut from said column at a tray location intermediate the column locations where said first stream and said raffinate stream enter said column, said desorbent stream comprising normal hexane and lower boiling hydrocarbons; and, (f) passing at least a portion of said desorbent stream to said adsorption zone and contacting said adsorbent material having normal pentane adsorbed thereon with said desorbent stream to desorb said normal pentane and produce said extract stream.

* * * * *